US005896749A

United States Patent [19]

Livers, Jr.

[11] Patent Number: 5,896,749

[45] Date of Patent: Apr. 27, 1999

[54] ACTIVE DAMPER CIRCUIT

[75] Inventor: James D. Livers, Jr., Cookeville, Tenn.

[73] Assignee: France/Scott Fetzer Company, Westlake, Ohio

[21] Appl. No.: 08/984,866

[22] Filed: Dec. 4, 1997

[51] Int. Cl.[6] ..... F25D 17/04

[52] U.S. Cl. ..... 62/187; 62/404

[58] Field of Search ..... 62/186, 187, 182, 62/408

[56] References Cited

U.S. PATENT DOCUMENTS

| | | | |
|---|---|---|---|
| 2,997,857 | 8/1961 | Clark | 62/187 X |
| 5,018,364 | 5/1991 | Chesnut et al. | 62/187 |
| 5,477,699 | 12/1995 | Guess et al. | 62/187 |

*Primary Examiner*—Henry Bennett
*Assistant Examiner*—Susanne C. Tinker
*Attorney, Agent, or Firm*—Wood, Herron & Evans, L.L.P.

[57] ABSTRACT

A refrigeration and active damper control circuit uses a single-pole thermostatic switch to control the damper motor for the fresh food compartment of a refrigeration unit. When the thermostatic switch is closed, the control circuit connects current from the electrical power source directly to the damper motor through the thermostatic switch; when the thermostatic switch is open, the control circuit connects current from the electrical power source through the evaporator fan motor and then through the damper motor. The damper motor has an electrical resistance substantially larger than that of the evaporator fan motor, so that during the latter series connection of the evaporator fan motor and damper motor, a sufficient voltage drop develops across the damper motor so that the damper will be closed by the damper motor. Since the evaporator fan motor is used to connect current to the damper motor when the thermostatic switch is open, it is not necessary to use a dual-pole thermostatic switch to control the damper motor. Rather, only a single-pole thermostatic switch will suffice. This substantially reduces the cost of the control circuit, and may also improve reliability.

25 Claims, 4 Drawing Sheets

ACTIVE DAMPER CIRCUIT

FIELD OF THE INVENTION

The present invention relates to electric circuits for controlling the electrical components of a refrigeration unit having an active damper therein.

BACKGROUND OF THE INVENTION

A commercial or domestic refrigeration unit (e.g. a refrigerator or freezer) typically includes several electrical components which must be activated in a thermostatically controlled manner to provide refrigeration. These components typically include a compressor and electric fans. The compressor compresses the cooling media upon exit from the evaporator inside of the refrigeration unit, and delivers the compressed cooling media to a condenser outside of the refrigeration unit. The electric fans are typically positioned adjacent to the evaporator inside of the unit and adjacent to the condenser outside of the unit, to effect heat transfer to/from the evaporator and condenser to the air surrounding those components. Typically, power is provided to the compressor and fans by a thermostatic switch located inside of the refrigeration unit; in essence, the thermostatic switch closes when the inside temperature exceeds a threshold, causing power to be applied simultaneously to the compressor and fans. Power continues to be applied until the inside temperature reduces and the thermostatic switch opens, at which time the compressor and fans turn off.

Some modern refrigeration units include a fresh food compartment, which has a separately controlled temperature. The fresh food compartment is typically a drawer which when closed is isolated from the main compartment. To provide cooling to the fresh food compartment, the fresh food compartment is typically equipped with an active damper door, controlled by a damper motor. When open, the damper door permits cool air from the main refrigeration compartment into the fresh food compartment. (While the damper door is open, typically the evaporator fan is energized to move cool air from inside of the refrigeration unit into the fresh food compartment.) When the damper door is closed, the fresh food compartment is isolated from the main compartment, so that its temperature can be controlled separately from the main compartment.

In a typical refrigeration unit, the fresh food compartment is equipped with its own thermostatic switch to permit thermostatic control of the temperature of the fresh food compartment. This thermostatic switch detects when the temperature of the fresh food compartment exceeds a threshold, indicating that cool air from the main compartment must be introduced into the fresh food compartment. When the thermostatic switch detects this condition, the thermostatic switch changes state to its "hot" condition, in which it delivers electrical power to the damper motor to open the damper, and also delivers electrical power to the evaporator fan. When the fresh food compartment cools, the thermostatic switch again changes state to its "cool" condition, in which it delivers electrical power to the damper motor to close the damper, and ceases delivery of electrical power to the evaporator fan.

In a typical refrigeration unit, the fresh food compartment thermostatic switch is typically a dual-pole thermostatic switch. It appears that a dual-pole thermostatic switch has been used for this application, because power must be delivered to the damper motor to cause the damper motor to move (open or close) the damper door, both when the thermostatic switch changes state from its "cool" condition to its "hot" condition, and when the thermostatic switch changes back from its "hot" condition to its "cool" condition. A dual-pole thermostatic switch provides a ready means to provide power to the damper motor when the thermostatic switch is in both of its conditions.

Unfortunately, the use of a dual-pole thermostatic switch to control the fresh food compartment damper, substantially increases the cost of the refrigeration control circuit, and may also reduce the reliability of the circuit as a result of the greater number of contact points in a dual-pole thermostatic switch as compared to a single-pole thermostatic switch.

SUMMARY OF THE INVENTION

In accordance with the principles of the present invention, these cost and potential reliability difficulties are avoided, through a novel refrigeration and active damper control circuit which uses a single-pole thermostatic switch to control the damper motor for the fresh food compartment of a refrigeration unit.

Specifically, in one aspect, the invention features an active damper control circuit for supplying current from an electrical power source to a damper motor and evaporator fan motor of a refrigeration unit. The control circuit incorporates a thermostatic switch, and provides further connections such that in a first state of the thermostatic switch, the control circuit connects current from the electrical power source directly to the damper motor, and in a second state of the thermostatic switch the control circuit connects current from the electrical power source through the evaporator fan motor and then through the damper motor. The damper motor has an electrical resistance substantially larger than that of the evaporator fan motor, so that during the latter series connection of the evaporator fan motor and damper motor, a sufficient voltage drop develops across the damper motor so that the damper will be moved by the damper motor.

Since the evaporator fan motor is used to connect current to the damper motor in the second state of the thermostatic switch, it is not necessary for the control circuit to use a dual-pole thermostatic switch to control the damper motor. Rather, only a single-pole thermostatic switch will suffice. This substantially reduces the cost of the control circuit, and may also improve reliability.

Thus, in a second aspect, the invention generally features an active damper control circuit for supplying current from an electrical power source to a damper motor, which incorporates a single-pole thermostatic switch. When the single-pole thermostatic switch is closed, the thermostatic switch connects current from the electrical power source to the damper motor to move the damper. When the single-pole thermostatic switch is open, current is otherwise connected from the electrical power source to the damper motor through the control circuit.

In particular embodiments of these aspects of the invention, the control circuit incorporates three mechanical switches, each mechanically controlled by the position of the damper and damper motor, to appropriately supply current in the described manner. Detailed embodiments showing the specific placement and connection of these mechanical switches, and the cycle performed by the active damper control circuit, are elaborated in the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
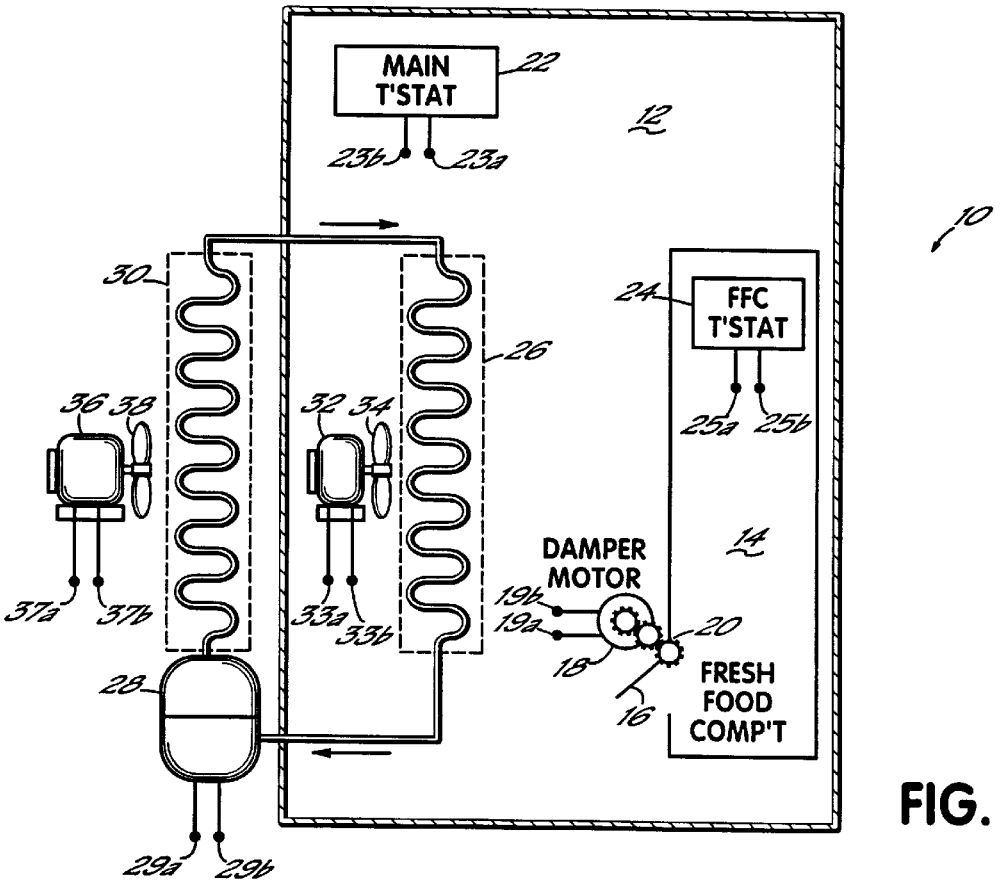
FIG. 1 is a schematic diagram of the major electrical components of a refrigeration unit having a main compartment the environment of which is controlled in response to a main thermostatic switch, and a fresh food compartment, the environment of which is controlled in response to a fresh food compartment thermostatic switch.

Referring now to FIG. 1 there can be seen the major electrical components of a refrigeration unit 10 such as a commercial or domestic refrigerator or freezer. Specifically, the refrigeration unit 10 includes a main compartment 12, and included therein a fresh food compartment 14 which is separately environmentally controlled. Under thermostatic control, the main and fresh food compartments can be coupled together, via a damper door 16. Damper door 16 is opened and closed by a damper motor 18, which drives the damper door 16 to its open and closed positions through a gear train and/or drive clutch mechanism 20.

Damper motor 18 is an electric motor, powered by electrical current passing through its terminals 19*a* and 19*b*. In one embodiment, damper motor 18 is a reversible motor, which reverses direction each time power is applied thereto. Thus, by alternately applying and removing power from damper motor 18, damper motor 18 is made to open and close damper door 16.

Inside of main compartment 12 is a main thermostat 22, including as a primary component a thermostatic switch, which in a typical application is an adjustable switch so that the temperature of the main compartment can be controlled by the owner. The thermostatic switch inside of thermostat 22 has first and second terminals 23*a* and 23*b*. When the temperature of thermostat 22 is elevated above its set point, the internal thermostatic switch closes, conducting electric current between terminals 23*a* and 23*b*. Otherwise, when the temperature of thermostat 22 is below its set point, the internal thermostatic switch remains open, and will not conduct electric current between terminals 23*a* and 23*b*.

Inside of the fresh food compartment 14 is a fresh food thermostat 24, which has as a primary component a second thermostatic, and in a typical application is also adjustable. The thermostatic switch inside of thermostat 24 has first and second terminals 25*a* and 25*b*. When the temperature of thermostat 24 is elevated above its set point, the internal thermostatic switch closes, conducting electric current between terminals 25*a* and 25*b*. Otherwise, when the temperature of thermostat 24 is below its set point, the internal thermostatic switch remains open, and will not conduct electric current between terminals 25*a* and 25*b*.

Refrigeration unit 10 is cooled by a heat transfer engine, which generates heat transfer from the main compartment 12 by the cyclical compression, condensation, decompression and evaporation of a thermally coupled refrigerant, captured in a thermodynamic loop. The thermodynamic loop includes an evaporator 26, compressor 28, and condenser 30. As the refrigerant passes through evaporator 26, which is located inside of the main compartment 12, the refrigerant evaporates from a liquid to a gaseous state, absorbing heat transfer from the main compartment 12 into the refrigerant. The primarily gaseous refrigerant is delivered at the outlet of evaporator 26 to compressor 28, which compresses the refrigerant to a high pressure. The refrigerant then passes through condenser 30, where heat transfers from the refrigerant to the environment external to main compartment 12, causing the refrigerant to condense from a primarily gaseous state to a primarily liquid state. The liquid refrigerant then passes back into the inlet of evaporator 26, completing the cycle.

Compressor 28 compresses primarily gaseous refrigerant received from evaporator 26, and delivers compressed refrigerant to condenser by the application of mechanical force generated by an electric motor. This electric motor is powered by electric current received by the motor through terminals 29*a* and 29*b* of the electric motor.

To facilitate heat transfer to/from evaporator 26 and condenser 30, fans are included in the refrigeration unit 10. Specifically, an evaporator fan motor 32 spins evaporator fan blades 34 to produce air flow over the coils of evaporator 26 to aid heat transfer to evaporator 26 from the air of main compartment 12. Similarly, a condenser fan motor 36 spins condenser fan blades 38 to produce air flow over the coils of condenser 30 to aid heat transfer from condenser 30 to the air external to main compartment 12. Evaporator fan motor 32 and condenser fan motor 36 are both electric motors, powered by electric current passing through their respective terminals 33*a* and 33*b*, and 37*a* and 37*b*.

Referring now to FIGS. 2A–2F, the electric control circuit for refrigeration unit 10, includes switches and wires connecting each of the electrical components illustrated in FIG. 1. Specifically, an electric power source supplies electrical power to the refrigeration unit 10 in the form of current passing between a "power" terminal 40 and a "ground" terminal 42. Power from this power source is switched to the various electrical elements of the refrigeration unit 10 via the thermostats 22 and 24 as well as first, second and third mechanically actuated two-pole switches 44, 46 and 48. The switching element of the three mechanically actuated two-pole switches 44, 46 and 48 is mechanically linked to the motion of the damper motor and damper door 16, so that these switches assume various positions dependent upon the position of the damper door, as discussed below.

In the circuit illustrated in FIGS. 2A–2F, the power terminal 40 of the electrical power source is connected to the first terminal 23*a* of the main compartment thermostat 22, to the first pole terminal 45*b* of the first mechanical switch 44, and to the first pole terminal 47*b* of the second mechanically actuated switch 46. The second terminal 23*b* of the main compartment thermostat is connected to the second pole terminal 47*c* of the second mechanically actuated switch 46, to the first terminal 37*a* of the condenser fan 36, and to the first terminal 29*a* of the compressor motor 28. The second terminals 37*b* and 29*b* of the condenser fan motor 36 and compressor motor 28, are both respectively connected to the ground terminal 42 of the electrical power source.

The common terminal 47*a* of the second mechanically actuated switch 46 is connected to the first terminal 33*a* of the evaporator fan motor 32, and the second terminal 33*b* of the evaporator fan motor 32 is connected to the common terminal 49*a* of the third mechanically actuated switch. The first pole terminal 49*b* of the third mechanically actuated switch 48 is connected to the first terminal 19*a* of the damper motor 18, and to the first terminal 25*a* of the fresh food compartment thermostat 24. The second terminal 25*b* of the fresh food compartment thermostat 24 is connected to the common terminal 45*a* of the first mechanically actuated switch 44. Finally, the second terminal 19*b* of the damper motor 18, the second pole terminal 49*c* of the second mechanically actuated switch 48, and the second pole terminal 45*c* of the first mechanically actuated switch 44, are all respectively connected to the ground terminal 42 of the electrical power source.

Figure 2A:
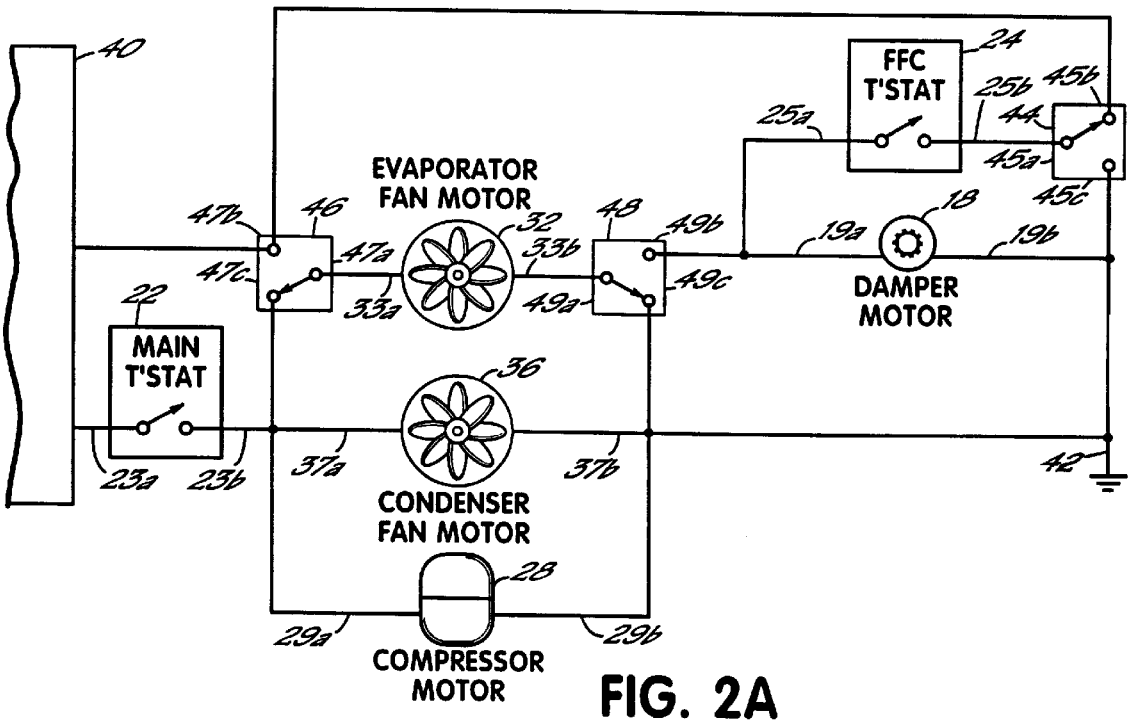
FIGS. 2A, 2B, 2C, 2D, 2E and 2F are electrical schematic drawings of the major electrical components of the refrigeration unit of FIG. 1 connected together with mechanical switches to form an active damper control circuit, and sequentially illustrating the states of the thermostatic and mechanical switches of this control circuit during cycling of the damper door between its open and closed positions.

In use, as a result of the above connections, appropriate operation of the various motors and fans is achieved. Specifically, FIG. 2A illustrates the condition of the mechanically actuated and thermostatic switches when both thermostats 22 and 24 are in their "open" condition, and thus neither the main compartment nor the fresh food compartment are in need of additional cooling. Notably, in this state, electrical power is not provided to any of the motors or other electrical elements 18, 28, 32 or 36.

If, from the state illustrated in FIG. 2A, the main compartment temperature elevates to an extent that the main compartment thermostatic switch closes, then electric current will be between the electrical power source terminals 40 and 42 through the main compartment thermostat 22 between terminals 23*a* and 23*b*, and then through each of the condenser fan motor 36 and compressor motor 28. Current flowing through the main compartment thermostat 22 will also flow through the evaporator fan motor 32, provided that the damper door is closed at the time and mechanically actuated switches 46 and 48 are in the positions shown in FIG. 2A; if the damper door is open, current will flow through evaporator fan motor 32 via mechanically actuated switch 46, regardless of the state of the main compartment thermostat 22, as elaborated below with reference to FIGS. 2B–2F. Thus, if the main compartment thermostat closes, the compressor motor 28 and each of the condenser and evaporator fans 36 and 32 will operate, cooling the main compartment in the manner described above. This cooling activity will continue until the main compartment temperature dips below the threshold set by the main compartment thermostat 22, at which time the thermostatic switch will open, returning the circuit to the condition shown in FIG. 2A, at which time current will cease to flow through the compressor and condenser fan motors 28 and 36, and will also cease to flow through the evaporator fan motor 32 if the damper door is closed.

The above describes the operation of the circuit for cooling the main compartment of the refrigeration unit. To control the environment of the fresh food compartment, a more complex interaction is involved, as illustrated in the sequence of FIGS. 2A–2F.

Figure 2B:
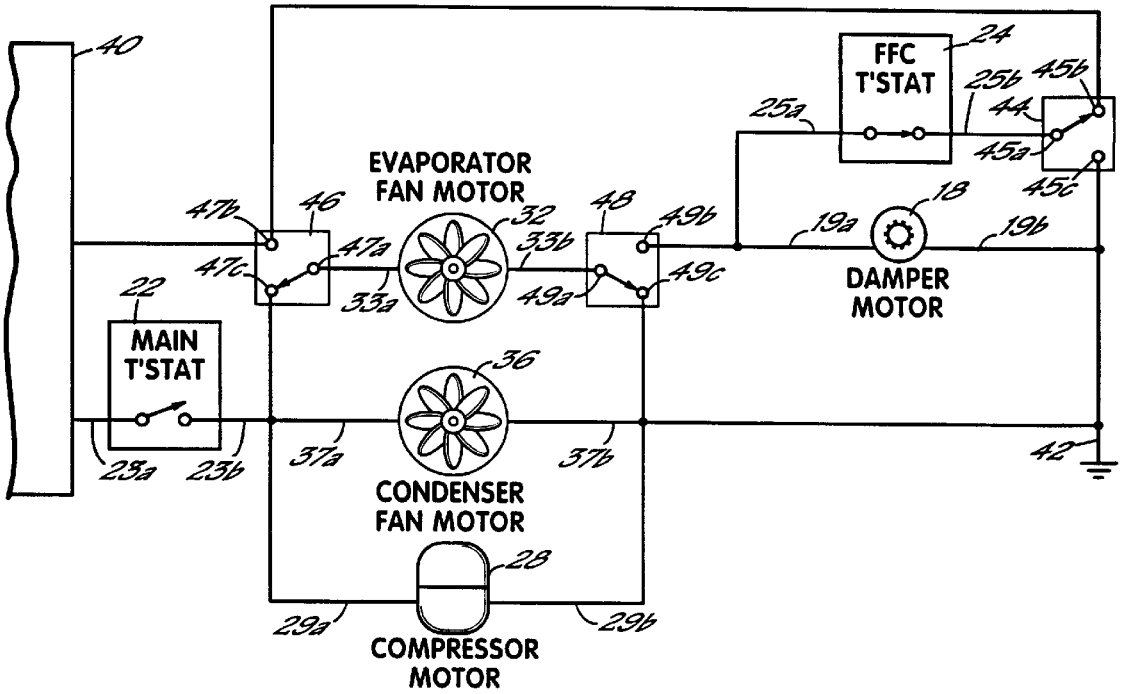
Figure 2C:
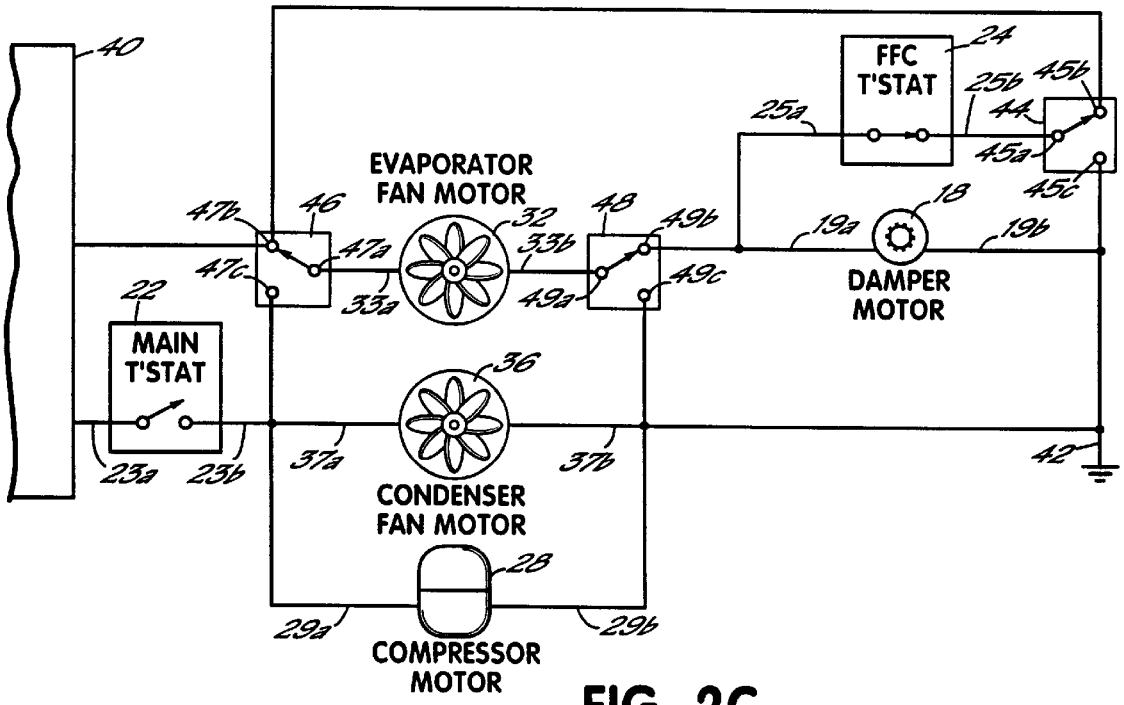

If the temperature of the fresh food compartment elevates above the threshold set by thermostat 24, the thermostatic switch in thermostat 24 will close, to the condition shown in FIG. 2B. In this position, electric current will flow between the electrical power source terminals 40 and 42 through terminals 45*b* and 45*a* of mechanically actuated switch 44, terminals 25*b* and 25*a* of thermostat 24, and then through damper motor 18 via terminals 19*a* and 19*b*. This electric current will energize damper motor 18 to begin to open the damper door 16 to permit cold air from the main compartment to enter the fresh food compartment.

Movement of the damper door 16 is linked to movement of the switch elements in each of the mechanically actuated switches 44, 46 and 48. Specifically, once damper door 16 moves from its closed toward its open position, the second and third mechanically actuated switches 46 and 48 change state to the positions shown in FIG. 2C. Later, once the damper door 16 is completely open, the first mechanically actuated switch 44 changes state to the position shown in FIG. 2D.

Figure 2D:
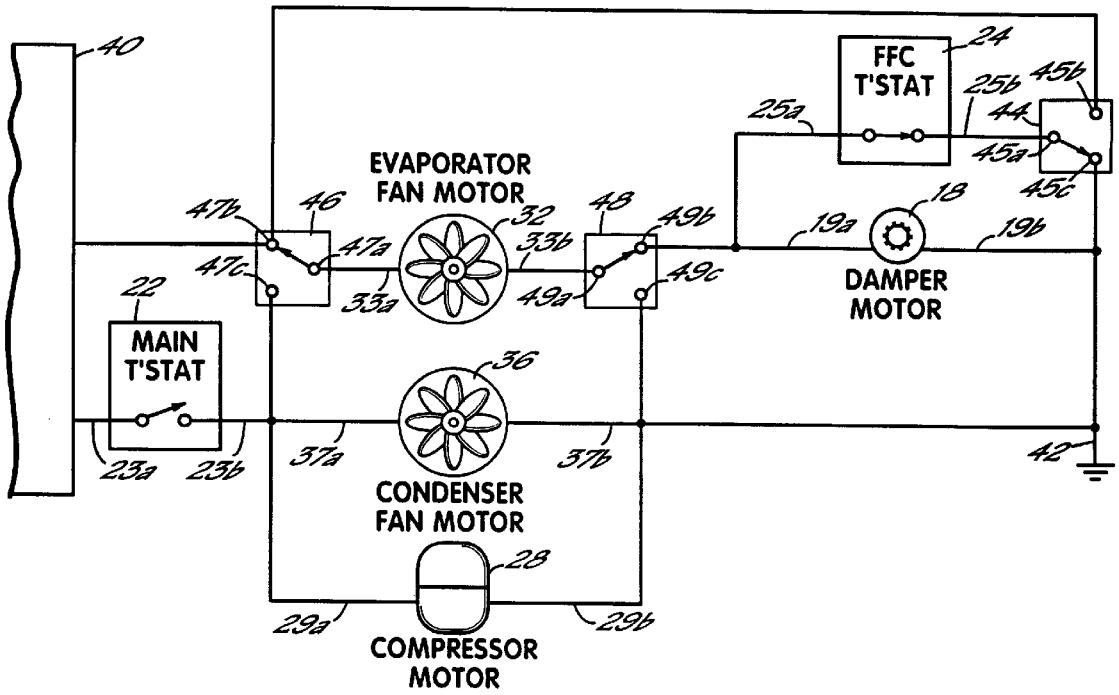

Once all three mechanically actuated switches 44, 46 and 48 have changed state to the positions shown in FIG. 2D, electrical current ceases flowing through the damper motor 18 (which is shorted out by the connection through the fresh food control thermostat 24 and first mechanically actuated switch 44), and electrical current begins to flow from the electrical power source terminals 40 and 42 through the evaporator fan motor 32, via terminals 47*b* and 47*a* of the second mechanically actuated switch 46, terminals 33*a* and 33*b* of the evaporator fan motor 32, terminals 49*a* and 49*b* of the third mechanically actuated switch 48, through the terminals 25*a* and 25*b* of the fresh food compartment thermostat 24 and through the terminals 45*a* and 45*c* of the first mechanically actuated switch 44.

Thus, once the damper door is open, the damper motor ceases to operate, and cool air from the main compartment of the refrigeration unit is brought into the fresh food compartment by the action of the evaporator fan. (Note that the evaporator fan will operate when the switches are in the state shown in FIG. 2D, regardless of the state of the main thermostat 22.)

Once the fresh food compartment has cooled to a temperature suitably below the threshold of the fresh food compartment thermostat 24, the fresh food compartment thermostat will open, resulting in the circuit configuration shown in FIG. 2E. In this configuration, current will continue to flow from the electrical power source terminals 40 and 42 through the evaporator fan motor 32, however, this current will now be diverted through the damper motor 18 and thereby energize damper motor 18 to close the damper door 16. Specifically, current will flow from between the electrical power source terminals 40 and 42 via terminals 47*b* and 47*a* of the second mechanically actuated switch 46, via terminals 33*a* and 33*b* of the evaporator fan motor 32, via terminals 49*a* and 49*b* of the third mechanical switch and then via the terminals 19*a* and 19*b* of the damper motor 18.

Figure 2E:
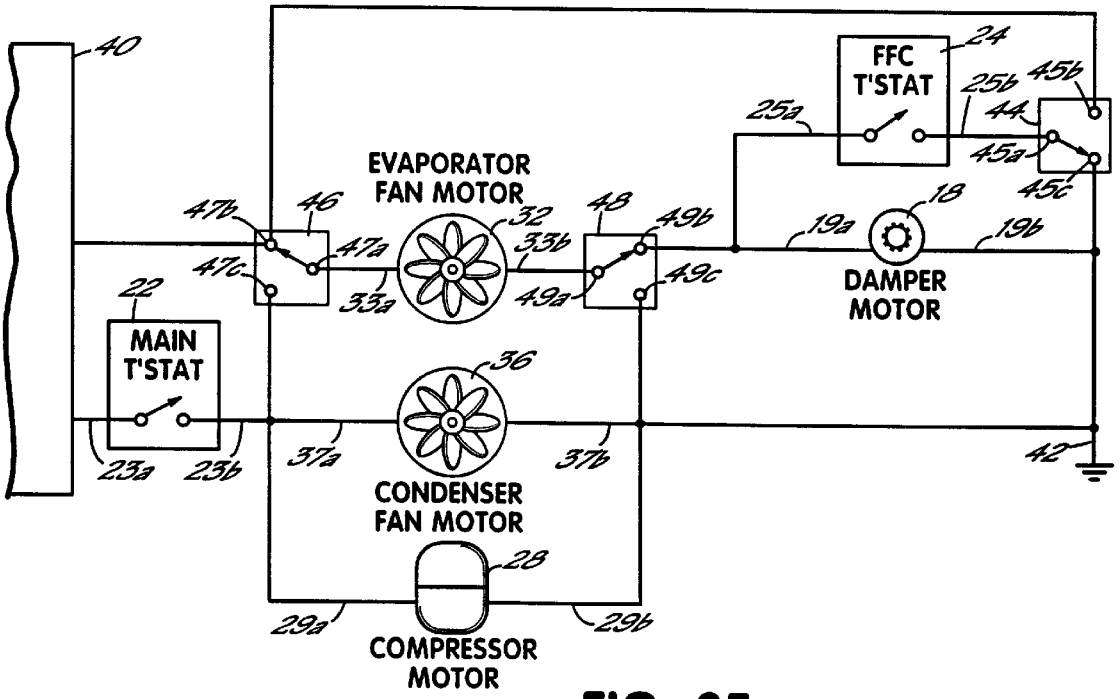
Figure 2F:
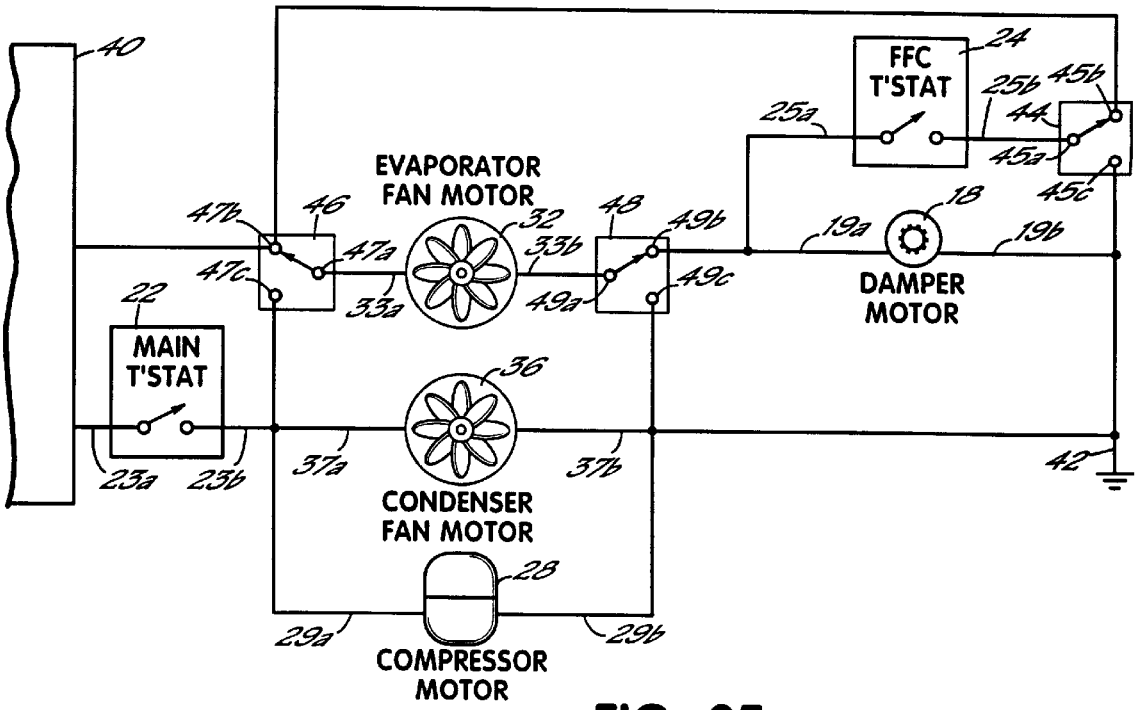

As the damper door begins to close from the condition shown in FIG. 2E, the first mechanically operated switch 44 changes state to the position shown in FIG. 2F. In the state illustrated in FIG. 2F, current continues to between the electrical power source terminals through the evaporator fan motor 32 and damper motor 18, as described with reference to FIG. 2E. Subsequently, when the damper door completely closes, the second and third mechanically operated switches 46 and 48 change state, returning the circuit to the state shown in FIG. 2A, and cutting off the path for current flow through damper motor 18, thus causing damper motor 18 to cease operating.

It will be noted that, in the circuit states shown in FIGS. 2E and 2F, damper motor 18 and evaporator fan motor 32 are connected in series to the electrical power source terminals 40 and 42. This temporary series connection provides a path for current flow to damper motor 18 to close the damper door 16 while the fresh food compartment thermostat 24 is in its open condition. The use of the evaporator fan motor 32 as a current path, eliminates the need to incorporate a dual-pole thermostat to control the damper motor 18. Damper motor 18 and evaporator fan motor 32 are chosen such that damper motor 18 has a substantially larger electrical resistance than evaporator fan motor 32, so that while the two motors are connected in series, a substantial portion of the voltage generated between the electrical power source terminals 40 and 42 appears across the damper motor terminals 19*a* and 19*b*, so that the damper motor 18 will energize and move the damper despite the series connected evaporator fan motor 32 interposed between the damper motor 18 and the electrical power source terminals. There may or may not be an insufficient remaining voltage across the evaporator fan motor 32 for the evaporator fan motor 32 to continue operation, (or there may only be a sufficient operation for slow speed operation of evaporator fan motor 32), but this is not a concern in that continuous operation of the evaporator fan is not necessary.

Thus, the novel refrigeration and active damper control circuit described herein, uses a single-pole thermostatic switch to control the damper motor for the fresh food compartment of a refrigeration unit, and thus avoids the cost and potential reliability drawbacks of using a dual-pole thermostat in controlling the damper motor.

While the present invention has been illustrated by a description of various embodiments and while these embodiments have been described in considerable detail it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An active damper control circuit for supplying current from an electrical power source to a damper motor and evaporator fan motor of a refrigeration unit to control operation of the damper motor and evaporator fan motor, the active damper control circuit comprising a plurality of electrical switches including one thermostatic switch, the control circuit applying power from said electrical power source to said damper motor and evaporator fan motor such that in a first state of the thermostatic switch, the control circuit connects current from the electrical power source directly to the damper motor, and in a second state of the thermostatic switch, the control circuit connects current from the electrical power source through the evaporator fan motor and then through the damper motor.

2. The active damper control circuit of claim 1 wherein said damper control circuit comprises a plurality of mechanical switches, each mechanical switch being mechanically controlled by movement of the damper motor.

3. The active damper control circuit of claim 2 wherein a first one of the mechanical switches has a common terminal connected to a first terminal of the thermostatic switch, a first pole terminal of the first mechanical switch being connected to a first terminal of the electrical power source, and a second pole terminal of the first mechanical switch being connected to a second terminal of the electrical power source.

4. The active damper control circuit of claim 3 wherein, when the damper motor has moved the damper to an open position, the first mechanical switch forms a connection between its common terminal and first pole terminal, and when damper motor has moved the damper to its closed position, the first mechanical switch forms a connection between its common terminal and second pole terminal.

5. The active damper control circuit of claim 3 wherein a second terminal of the thermostatic switch is connected to a first terminal of the damper motor, and a second terminal of the damper motor is connected to the second terminal of the electrical power source.

6. The active damper control circuit of claim 3 further comprising a second and a third mechanical switch each having a respective common terminal connected to opposite terminals of the evaporator fan motor.

7. The active damper control circuit of claim 6 wherein a first pole terminal of the second mechanical switch is connected to the first terminal of the electrical power source, and a first pole terminal of the third mechanical switch is connected to the first terminal of the damper motor.

8. The active damper control circuit of claim 7 wherein the second and third mechanical switches form connections between their respective common terminals and first pole terminals when the damper is open.

9. A refrigeration unit, comprising a main compartment, a compressor for compressing refrigerant, a condenser mounted external to the main compartment receiving compressed refrigerant from the compressor, and condensing the refrigerant and transferring heat from the refrigerant to a region outside of the main compartment, an evaporator mounted internal to the main compartment receiving condensed refrigerant from the condenser, and evaporating the refrigerant and transferring heat from the inside of the main compartment to the refrigerant, an evaporator fan motor internal to the main compartment for driving a fan and generating air flow over the evaporator, a subcompartment internal to the main compartment and thermally isolatable therefrom, the subcompartment having an active damper door which when opened permits air flow between the subcompartment and the main compartment, a damper motor for moving the damper door, the damper motor having an electrical resistance substantially larger than that of the evaporator fan motor, and an active damper control circuit for supplying current from an electrical power source to the damper motor and evaporator fan motor to control operation of the damper motor and evaporator fan motor, the active damper control circuit comprising a plurality of electrical switches including one thermostatic switch, the control circuit applying power from said electrical power source to the damper motor and evaporator fan motor such that in a first state of the thermostatic switch, the control circuit connects current from the electrical power source directly to the damper motor, and in a second state of the thermostatic switch, the control circuit connects current from the electrical power source through the evaporator fan motor and then through the damper motor.

10. The refrigeration unit of claim 9 wherein said damper control circuit comprises a plurality of mechanical switches, each mechanical switch being mechanically controlled by movement of the damper motor.

11. The refrigeration unit of claim 10 wherein a first one of the mechanical switches has a common terminal connected to a first terminal of the thermostatic switch, a first pole terminal of the first mechanical switch being connected to a first terminal of the electrical power source, and a second pole terminal of the first mechanical switch being connected to a second terminal of the electrical power source.

12. The refrigeration unit of claim 11 wherein, when the damper motor has moved the damper to an open position, the first mechanical switch forms a connection between its common terminal and first pole terminal, and when damper motor has moved the damper to its closed position, the first mechanical switch forms a connection between its common terminal and second pole terminal.

13. The refrigeration unit of claim 11 wherein a second terminal of the thermostatic switch is connected to a first terminal of the damper motor, and a second terminal of the damper motor is connected to the second terminal of the electrical power source.

14. The refrigeration unit of claim 11 further comprising a second and a third mechanical switch each having a respective common terminal connected to opposite terminals of the evaporator fan motor.

15. The refrigeration unit of claim 14 wherein a first pole terminal of the second mechanical switch is connected to the first terminal of the electrical power source and a first pole terminal of the third mechanical switch is connected to the first terminal of the damper motor.

16. The refrigeration unit of claim 15 wherein the second and third mechanical switches form connections between their respective common terminals and first pole terminals when the damper is open.

17. An active damper control circuit for supplying current from an electrical power source to a damper comprising a single-pole thermostatic switch, the active damper control circuit applying power from the electrical power source to the damper motor such that when the single-pole thermostatic switch is closed, the single-pole thermostatic switch connects current from the electrical power source to the damper motor, and when the single-pole thermostatic switch is open, current is connected from the electrical power source to the damper motor through the control circuit other than through the single-pole thermostatic switch.

18. The active damper control circuit of claim 17 wherein said damper control circuit comprises a plurality of mechanical switches, each mechanical switch being mechanically controlled by movement of the damper motor.

19. The active damper control circuit of claim 18 wherein a first one of the mechanical switches has a common terminal connected to a first terminal of the single-pole thermostatic switch, a first pole terminal connected to a first terminal of the electrical power source, and a second pole terminal connected to a second terminal of the electrical power source.

20. The active damper control circuit of claim 19 wherein, when the damper motor has moved the damper to an open position, the first mechanical switch forms a connection between its common terminal and first pole terminal, and when damper motor has moved the damper to its closed position, the first mechanical switch forms a connection between its common terminal and second pole terminal.

21. The active damper control circuit of claim 19 wherein a second terminal of the single-pole thermostatic switch is connected to a first terminal of the damper motor, and a second terminal of the damper motor is connected to the second terminal of the electrical power source.

22. The active damper control circuit of claim 19 further comprising a second and a third mechanical switch each having a respective common terminal connected to opposite terminals of the evaporator fan motor.

23. The active damper control circuit of claim 22 wherein a first pole terminal of the second mechanical switch is connected to the first terminal of the electrical power source, and a first pole terminal of the third mechanical switch is connected to the first terminal of the damper motor.

24. The active damper control circuit of claim 23 wherein the second and third mechanical switches form connections between their respective common terminals and first pole terminals when the damper is open.

25. An active damper control circuit for supplying current from an electrical power source to a damper motor and fan motor of a refrigeration unit to open and close an active damper and activate a fan, the control circuit comprising a plurality of electrical switches including first and second single-pole thermostatic switches each having a first and a second state, the control circuit, during a first state of said first thermostatic switch, supplying current from said electrical power source to said damper motor and to said fan motor to open said damper and activate said fan while said damper is open, regardless of a state of said second thermostatic switch, the control circuit, during a second state of said first thermostatic switch, supplying current from said electrical power source to said damper motor to close said damper, regardless of a state of said second thermostatic switch, and supplying current from said electrical power source to said fan motor to operate said fan while said damper is closed, if said second thermostatic switch is in a first state.

* * * * *